US006679271B2

(12) United States Patent
Choe

(10) Patent No.: US 6,679,271 B2
(45) Date of Patent: Jan. 20, 2004

(54) NAIL CARE APPARATUS AND MANUFACTURING METHOD THEREOF

(75) Inventor: Sunjeen Choe, Fullerton, CA (US)

(73) Assignee: Sunjeen, Inc., Fullerton, CA (US)

( * ) Notice: Subject to any disclaimer, the term of this patent is extended or adjusted under 35 U.S.C. 154(b) by 0 days.

(21) Appl. No.: 10/099,324

(22) Filed: Mar. 15, 2002

(65) Prior Publication Data

US 2003/0172946 A1 Sep. 18, 2003

(51) Int. Cl.[7] ..... A45D 29/18; A45D 29/05; A45D 24/00

(52) U.S. Cl. ..... 132/76.4; 132/73.6; 132/200

(58) Field of Search ..... 132/76.4, 75.8, 132/75.6, 75.3, 73.6, 73.5, 73, 200; 451/490, 502, 523

(56) References Cited

U.S. PATENT DOCUMENTS 1,482,837 A * 2/1924 Buck ..... 132/76.4
1,915,305 A * 6/1933 Gallagher ..... 132/76.4
2,075,932 A * 4/1937 Ehrmann ..... 132/76.4
4,440,182 A * 4/1984 Holm ..... 132/75.6
4,854,334 A * 8/1989 Su ..... 132/73.6
5,161,552 A * 11/1992 Kathuria ..... 132/73.6
5,177,909 A * 1/1993 Klocke ..... 51/358
6,471,712 B2 * 10/2002 Burres ..... 606/131
6,494,213 B2 * 12/2002 Calafut ..... 132/76.4

* cited by examiner

*Primary Examiner*—John J. Wilson
*Assistant Examiner*—Robyn Kieu Doan
(74) *Attorney, Agent, or Firm*—Lee, Hong, Degerman, Kang & Schmadeka

(57) ABSTRACT

A nail care apparatus comprises a motor housing having two ends: a handle end and a rotating housing end. A replaceable tip is inserted into the rotating housing so that it rotates along with the housing end. A disposable manicuring cylinder that is comprised of a soft polyurethane rubber in the shape of a hollow cylinder is then secured onto the replaceable tip, allowing it to rotate along with the replaceable tip. A power supply is connected to the housing at the handle end and provides power to an electric motor inside the motor housing such that the operation of the motor causes rotational movement of the rotating housing. The manicuring cylinders would be manufactured by slicing long tubes polyurethane rubber into desired lengths. The outer surface of the manicuring cylinder would be granular due to either a surface coating of sand powder mixed with adhesive or a sandpaper laminate, thus allowing uniform and even buffing and polishing without the risk of unnecessary keratin erosion.

7 Claims, 3 Drawing Sheets

NAIL CARE APPARATUS AND MANUFACTURING METHOD THEREOF

BACKGROUND OF THE INVENTION

1. Field of the Invention

The present invention relates to a nail care apparatus, and more specifically to disposable polyurethane manicuring cylinders used with a motorized device that buff and polish nails and a method of manufacturing such discs.

2. Description of the Related Art

It is well known in the prior art that motorized fingernail grooming devices, preferably of the rotating kind, provide more uniform results in the filing, cleaning, buffing and polishing of nails than would manual devices. Manual nail grooming devices require greater amounts of time, effort and concentration by the user than motorized devices when attempting to groom fingernails. This is due to the user's inability to apply equal pressure and speed when applying the device to fingernails. Often, the use of manual devices results in non-uniform quality in the care and appearance of nails, individually and collectively.

With respect to motorized nail grooming devices, the issue of consistent speed in applying care to fingernails has been resolved. However, the concern for equal pressure that is applied to all facets of each nail remains. Unfortunately, any practical means of providing self-manicures cannot eliminate this concern. Most manual and motorized devices employ a hard manicuring surface, usually made of sandpaper, emery, or stone. Due to the rigidity and abrasiveness of such surfaces, excessive pressure by the user of manual and motorized devices would damage the nail by unintentionally grinding away keratin. Such excessive qualities would prohibit users with weak or fragile finger and toenails to use this type of device.

Motorized devices which employ rotating discs or cylinders to manicure nails utilize sandpaper or emery, which are placed onto a spindle. As shown in FIG. 1, prior art indicates that such discs are manufactured by winding a pliable strip of sandpaper or emery 10 of varying thickness around a solid core cylinder 20. After hardening, the solid core cylinder is extracted, resulting in a hardened tube composed of sandpaper or emery. The tube of hardened sandpaper or emery is then cut into several discs of varying height 30. Since the sandpaper or emery is wrapped around the solid core in a spiral action, the step of cutting the formed cylinder results in manicuring discs that contain a seam 40. Often times, this seam, which can be present throughout the entire circumference of the disc depending upon the height, will not contain the abrasive surface qualities of the sandpaper or emery. As a result, uneven filing and polishing would occur despite the presence of equal and consistent pressure and speed in the application of the filing or polishing surface to the nail.

For the foregoing reasons, there is a need for a nail care apparatus that can efficiently and uniformly buff and polish nails with a more malleable and consistent surface application.

SUMMARY OF THE INVENTION

Accordingly, the present invention is directed to a nail care apparatus that substantially obviates one or more of the problems due to limitations and disadvantages of the related art.

An object of the present invention is to provide a nail care apparatus that utilizes a rotating cylinder with a polyurethane core to buff and polish nails evenly and uniformly.

Another object of the present invention is to provide a compressible manicuring cylinder such that excessive pressure in the application of the device to the nail will not result in unintended grinding away of keratin.

Another object of the present invention is to provide a manicuring cylinder without seams present on the surface of the cylinder.

Another object of the present invention is to provide a means of manufacturing seamless and soft manicuring cylinder.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a nail care apparatus comprises a motor housing having two ends: a handle end and a rotating housing end. A replaceable tip is inserted into the rotating housing so that it rotates along with the housing end. A disposable manicuring cylinder that is hollow and is comprised of a soft polyurethane rubber is then secured onto the replaceable tip, allowing it to rotate along with the replaceable tip. A power supply is connected to the housing at the handle end and provides power to an electric motor inside the motor housing such that the operation of the motor causes rotational movement of the rotating housing.

According to one aspect of the preferred embodiment, sand powder mixed with an adhesive is placed onto the surface of the manicuring cylinder.

According to another aspect of the preferred embodiment, a sandpaper laminate is placed onto the surface of the manicuring cylinder.

It is to be understood that both the foregoing general description and the following detailed description are exemplary and explanatory and are intended to provide a further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

DETAILED DESCRIPTION OF THE PREFERRED EMBODIMENTS

Figure 1:
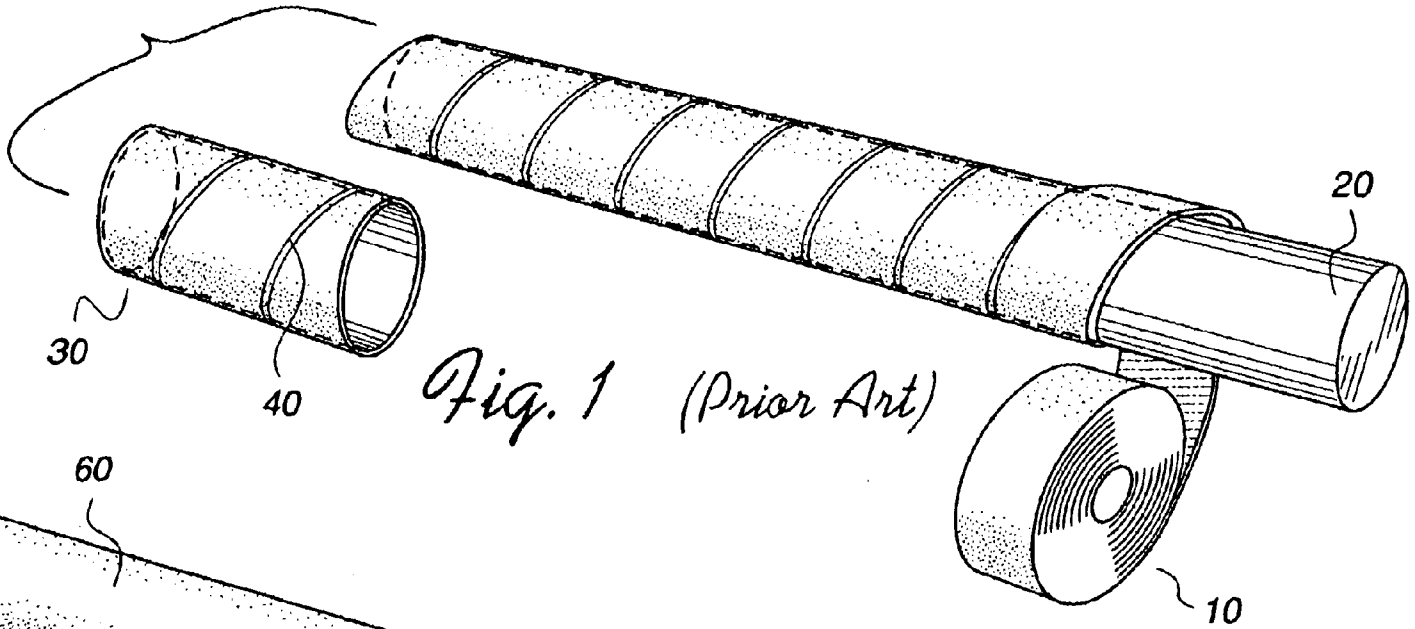
Fig. 1 (Prior Art)
FIG. 1 illustrates a perspective view of a hollow cylinder with a strip of sandpaper winding over it according to prior art.
Figure 2:
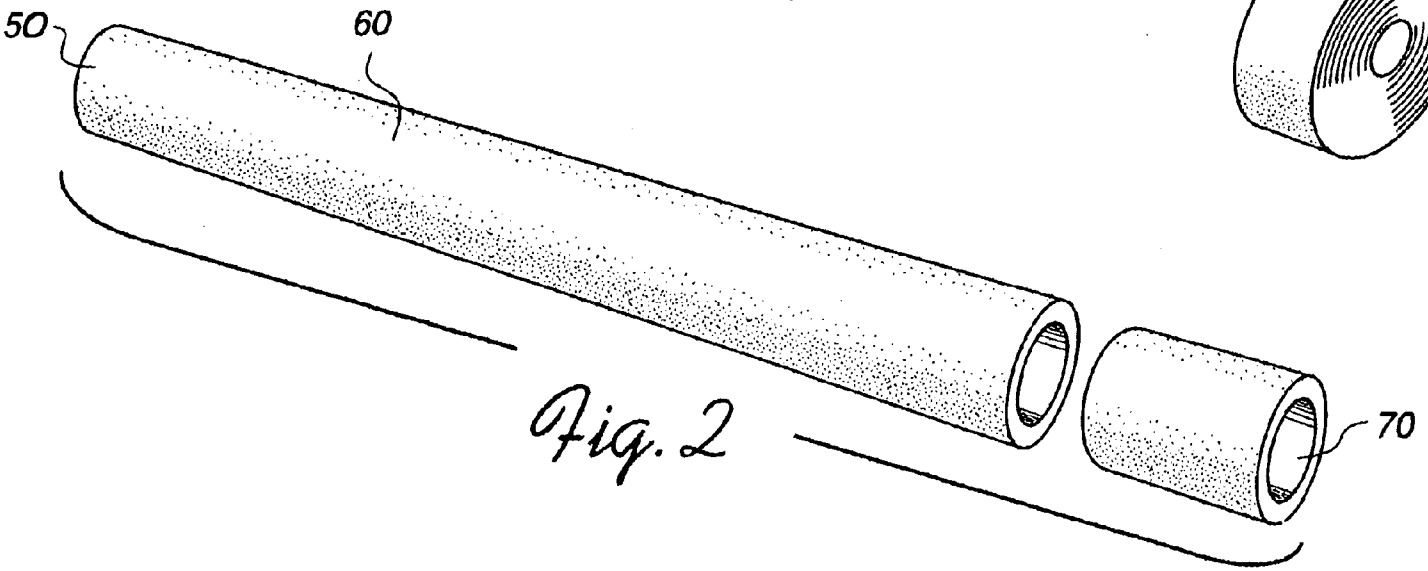
FIG. 2 illustrates a perspective view of a soft, hollow polyurethane cylinder core with a granular outer surface according to the preferred embodiment of the present invention.
Figure 3:
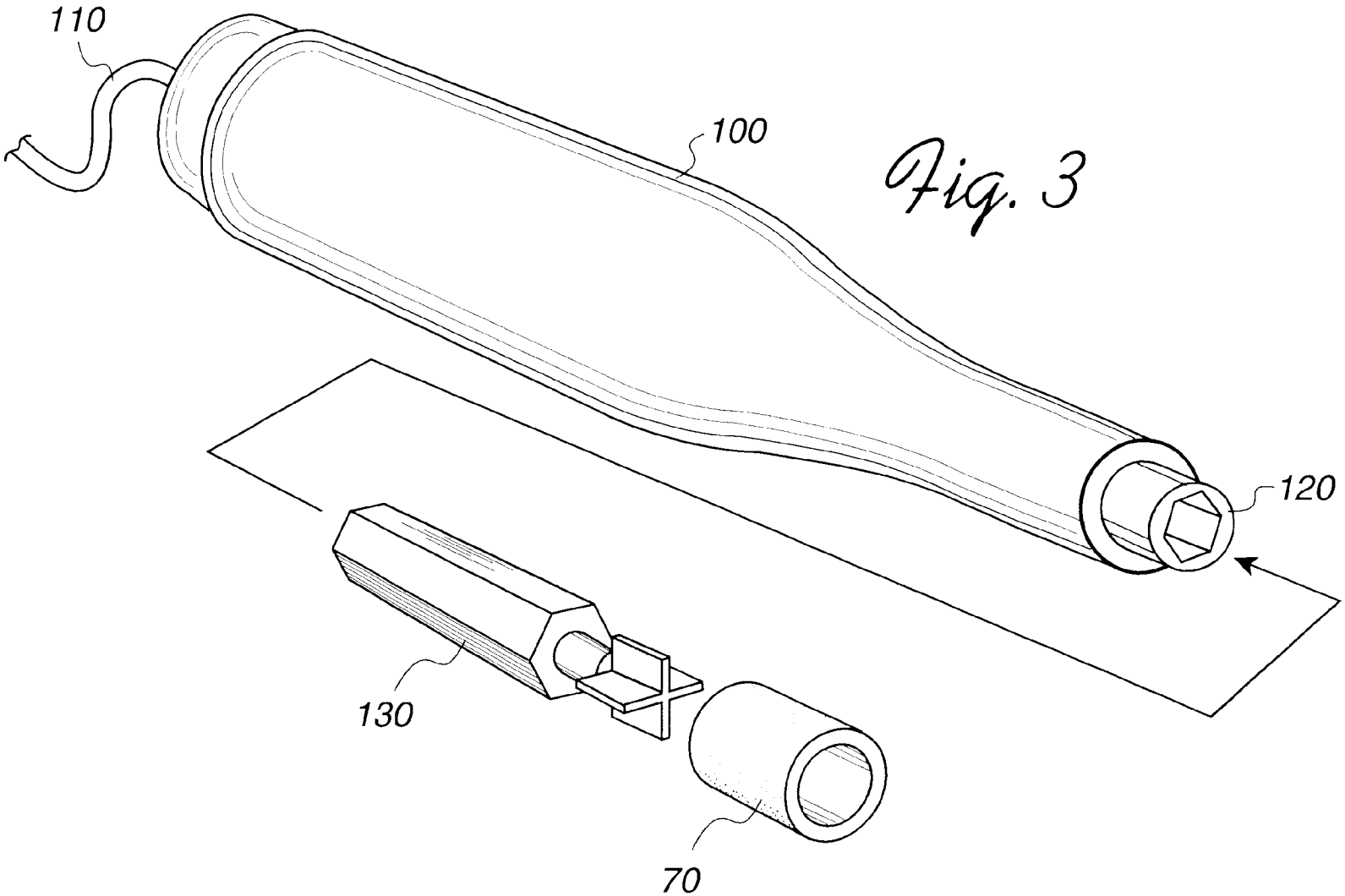
FIG. 3 illustrates a perspective view of the nail care apparatus according to the preferred embodiment of the present invention.

With reference to FIGS. 2 and 3 thereof, a nail care apparatus embodying the principles and concepts of the present invention will be described.

FIG. 2 illustrates a perspective view of soft, hollow polyurethane cylinder core 50 with a granular outer surface 60. The grainy surface characteristic is achieved by placing onto the outer surface 60 sand powder mixed with adhesive via aerosol means or other suitable process, a sandpaper laminate or other granular processes known to one of ordinary skill in the art. The cylinder core 50 is then sliced into smaller cylinders of varying height, exemplified by the cylinder 70, to provide a seamless and soft manicuring cylinder that will uniformly and evenly buff and polish fingernails without unnecessarily grinding away keratin. The inner diameter of the cylinder core 50 and of the manicuring cylinder 70 is of an appropriate length corresponding to the diameter of a spindle or shaft that the manicuring cylinder 70 is to be located on.

In addition, the abrasive surface characteristic of the manicuring cylinder can be manipulated by varying the concentration and particle size of the sand powder when mixed with the adhesive. Mixtures with higher concentrations of sand powder or with larger particle size sand powder, when applied to the surface 60 of the manicuring cylinder core 50, would result in manicuring cylinders 70 that offer greater filing and buffing capabilities. For nails requiring detailed applications, manicuring cylinders 70 produced from cores 50 that are sprayed with less concentrated mixtures. The grainy surface characteristic of the cylinder core 50 could also be controlled through the type and quality of the sandpaper that is laminated to the surface 60.

As mentioned above, the cylinders with different internal and external diameters can be sliced into varying heights. For larger surface applications, such as thumbnails and nails of the big toe, a larger external diameter as well as increased height would be desired to provide for a cylinder with a greater surface area. A greater cylinder surface area would result in an increased viability of the nail care cylinder because the abrasive qualities of the surface would decay at a slower rate. Also, cylinders with greater external diameters would be appropriate for surface applications that do not require a significant amount of polishing. The increased external diameter results in a decreased rotation rate of the cylinder. Slower speeds allow the user to manipulate the nail care apparatus into polishing nails to a lesser degree.

FIG. 3 illustrates a perspective view of the nail care apparatus. A motor housing 100 is connected to a power supply (not shown). Within the motor housing is an electric motor that draws power from the power supply via the electrical connection 110. The operation of the electric motor causes a rotational movement of the rotating housing 120, which can also be a bearing. The first end of the replaceable tip 130 is securely inserted into the rotating housing 120 by means of friction fit or by other processes known to one of ordinary skill in the art. The manicuring cylinder 70 is then secured onto the second end of the replaceable tip 130 via friction fit or other suitable means of fastening known to one of ordinary skill in the art.

Since the manicuring cylinders can be sliced into varying heights, the second end of the replaceable tip 130 must have sufficient length so as to provide stability for the manicuring cylinder 70. Due to the malleable characteristics of the manicuring cylinder 70, a replaceable tip 130 with a second end with an insufficient length would result in inadequate rigidity of the manicuring cylinder to effectively polish nails. The second end of the replaceable tip 130 must provide adequate support so that the manicuring cylinder 70 does not collapse from the pressure applied by the user. The need for such support may be provided by sufficient contact area between the inner surface of the manicuring cylinder and second end of the replaceable tip. In FIG. 3, an example is shown where the second end of the replaceable tip 130 is a spindle with a four-pointed axis. Spindles with three or more axes may be equally appropriate in this application as well as other geometric shapes that provide sufficient contact area.

Similar to the attachment of the manicuring cylinder, the first end of the replaceable tip 130 must be securely inserted into the rotating housing 120. If inserted via friction fit, the contact area between the first end of the replaceable tip 130 and the inner surface of the rotating housing 120 must be sufficient to prevent slippage or disengagement between the replaceable tip 130 and the rotating housing 130. In FIG. 3, an example is shown where the first end of the replaceable tip 130 and the receptor site of the rotating housing 120 are hexagonal in shape. Other geometric shapes can be equally effective provided that there is sufficient contact area between the first end of the replaceable tip 130 and the inner surface of the rotating housing 120 and that slippage and disengagement do not occur.

Figure 4:
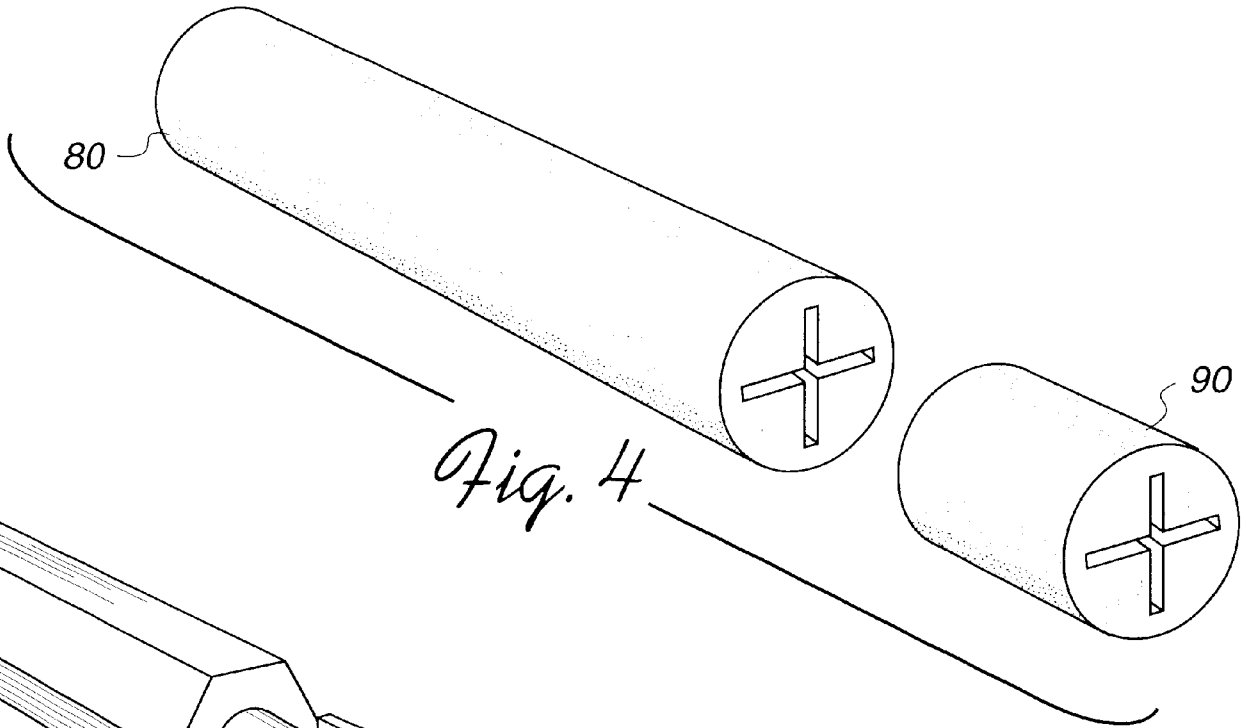
FIG. 4 illustrates a perspective view of a soft, hollow polyurethane cylinder core with a granular outer surface in accordance with the alternative embodiment of the present invention.
Figure 5:
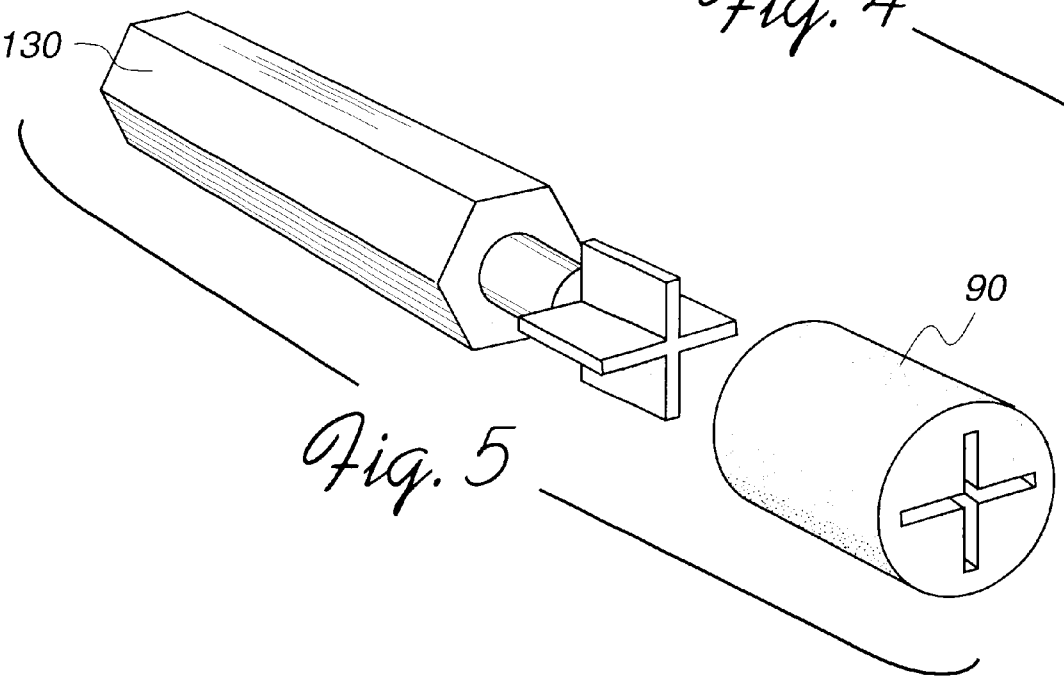
FIG. 5 illustrates a perspective view of the replaceable tip of the nail care apparatus and the manicuring cylinder in accordance with the alternative embodiment of the present invention.

FIG. 4 illustrates a perspective view of a soft, hollow polyurethane cylinder core 80 with a granular outer surface in accordance with an alternative embodiment of the present invention. The cylinder core 80 is then sliced into smaller cylinders of varying height, exemplified by the cylinder 90. In this embodiment, the inner surface of the hollow cylinder 90 is designed to form fit the replaceable tip 130, as shown in FIG. 5. Such an embodiment would provide added stability and rigidity in nail care applications should the user so desire. Although a cross pattern is depicted in FIGS. 4 and 5, the cylinder core 80 can be manufactured with inner surfaces designed to accommodate replaceable tips of various geometric shapes and sizes.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A nail care cylinder comprising soft, polyurethane rubber and having a shape of a hollow cylinder with inner and outer surfaces, wherein a mixture is directly placed onto the outer surface, the mixture comprising an adhesive and sand powder.

2. A nail care cylinder comprising soft, polyurethane rubber and having a shape of a hollow cylinder with inner and outer surfaces, wherein a sandpaper laminate is placed onto the outer surface.

3. A nail care apparatus comprising:

a motor housing having a handle end opposite a rotating housing end;

a rotating replaceable tip having first and second ends, wherein the first end is inserted into the rotating housing end of the motor housing and the rotating replaceable tip is detachably secured to and protruding from the rotating housing end;

a seamless manicuring cylinder detachably secured to the second end of the rotating replaceable tip, wherein the manicuring cylinder comprises:

inner and outer surfaces; and
soft, polyurethane rubber;

a power supply connected to the handle end of the motor housing; and an electric motor housed in the motor housing, the electric motor drawing power from the power supply, such that operation of the electric motor causes rotational movement of the rotating housing end.

4. The nail care apparatus of claim 3, wherein the manicuring cylinder further comprises a mixture directly placed onto the outer surface of the manicuring cylinder, wherein the mixture comprises an adhesive and sand powder.

5. The nail care apparatus of claim 3, wherein the manicuring cylinder further comprises a sandpaper laminate placed onto the outer surface of the manicuring cylinder.

6. A manufacturing method for manicuring cylinders for nail care apparatus comprising the steps of:

forming a hollow cylinder with inner and outer surfaces and comprising soft, polyurethane rubber;

spraying the outer surface of the hollow cylinder with a mixture comprising sand powder and an adhesive; and slicing the hollow cylinder into lengths.

7. A manufacturing method for manicuring cylinders for nail care apparatus comprising the steps of:

forming a hollow cylinder with inner and outer surfaces and comprising soft, polyurethane rubber;

placing a sandpaper laminate onto the outer surface of the hollow cylinder; and slicing the hollow cylinder into lengths.

* * * * *